United States Patent [19]

Martin

[11] 4,095,670

[45] Jun. 20, 1978

[54] FOLDABLE PLATFORM FOR RAISE DRILLING

[75] Inventor: Angus C. H. Martin, Mississauga, Canada

[73] Assignee: Raise Contracting, Limited, Mississauga, Canada

[21] Appl. No.: 759,438

[22] Filed: Jan. 14, 1977

[30] Foreign Application Priority Data

Jun. 9, 1976 Canada ..... 254476

[51] Int. Cl.[2] ..... E04G 3/10; E04G 3/14

[52] U.S. Cl. ..... 182/128; 182/131; 182/150; 182/223

[58] Field of Search ..... 182/152, 150, 142, 223, 182/131, 128, 132

[56] References Cited

U.S. PATENT DOCUMENTS 3,907,066 9/1975 Newton ..... 182/152

3,994,365 11/1976 Petermann ..... 182/142

FOREIGN PATENT DOCUMENTS 672,265 10/1963 Canada ..... 182/142

*Primary Examiner*—Reinaldo P. Machado

*Attorney, Agent, or Firm*—Sim & McBurney

[57] ABSTRACT

This invention provides a platform structure having a retractable floor portion consisting of four main floor panels extending outwardly in directions defining a cross, and pivotable between a horizontal and vertical position. There are also provided secondary floor panels for the quadrants between the main floor panels, the second floor panels being mounted to another main or secondary panel along aligned edges. The secondary floor panels can pivot through 90° or 180°, to permit all panels to be folded into an upright position, to lie along a central framework portion.

3 Claims, 7 Drawing Figures

FOLDABLE PLATFORM FOR RAISE DRILLING

Figure 1:
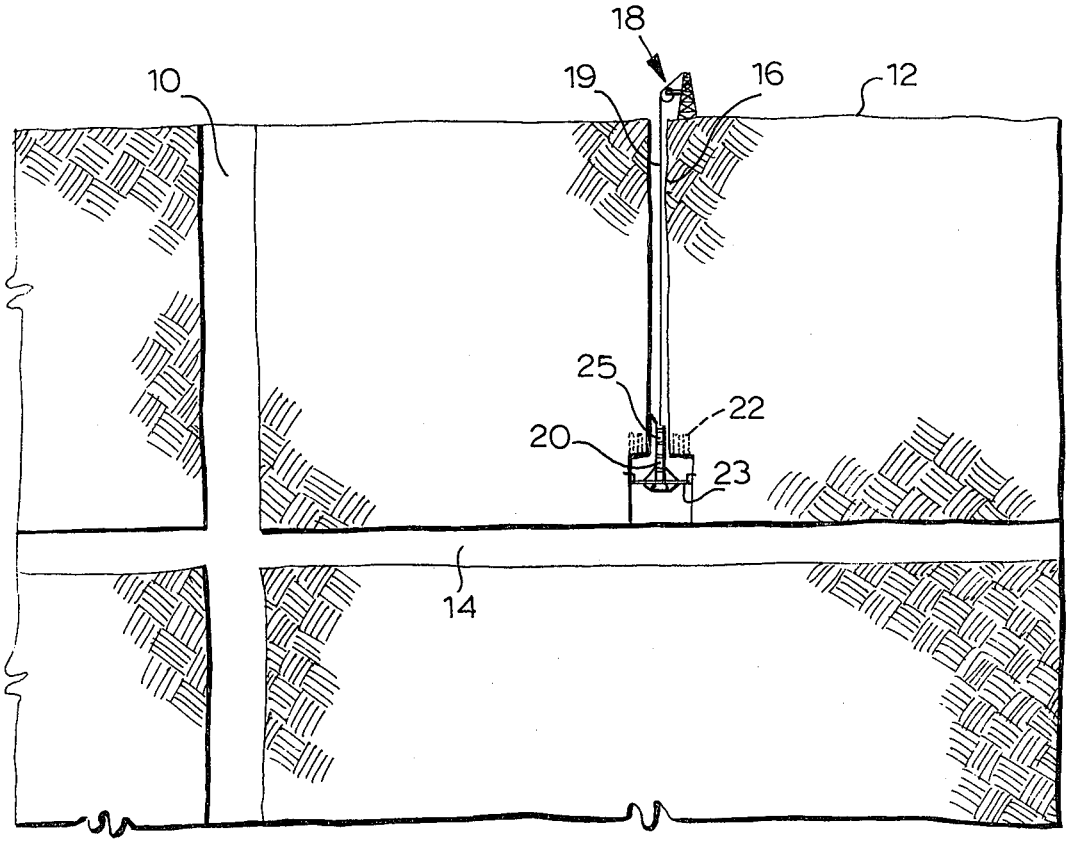

This invention relates to the mining industry generally, and has to do in particular with a folding work platform adapted to facilitate certain mining procedures.

In conventional mining procedures, a primary mine shaft is first provided, and one or more "levels" is cut radially outwardly from the primary mine shaft into veins containing the desired ore. Where an extended vein is beig mined, the level "working passage" can extend some considerable distance away from the primary mine shaft, and it can become more and more time-consuming and uneconomical to truck the mined ore back along the level to the primary mine shaft and thence up to the surface. In order to make the mining of this distant portion of the vein more economical, it is conventional practice to provide a "raise" which is an auxiliary shaft extending from the level up to the surface. The raise serves the same purposes as the primary mine shaft, mainly ventilation, traffic, ore removal, water and other supplies, and so forth. The drilling of a "raise" from a level to the surface is typically done in either two or three stages. In the two-stage operation, a first shaft is drilled downwardly from the surface at a diameter of about 8 feet, and this step involves the gradual lowering of workers supported on a 7-foot diameter platform, through the bottom of which they can drill vertical holes for the insertion of blasting powder. The initial 8-foot shaft is created by successively blasting away incremental layers as the work proceeds. The second step of the two-step procedure is to widen the 8-foot shaft to about 25 feet by drilling up from the bottom at a 25 foot diameter, and again blasting away incremental layers working from the bottom upwardly.

The three-step operation differs from the two-step operation only in that the 8-foot shaft itself is prepared in two steps. The first step is a simple boring operation from the top downwardly at a diameter of perhaps 1 foot, while the second is a reaming operation from underneath using a rotary reaming head on an enlarged conical holder, with the conical holder being pulled upwardly from underneath by a winch as it grinds the earth, rock, etc. away. The latter step would expand the 1-foot diameter bore hole up to an 8-foot diameter shaft, and then the third operation would be required to widen this to 25 feet.

It is an aspect of the present invention to facilitate the last step in each of these two conventional procedures, namely that of widening an 8-foot shaft to about 25 feet in diameter.

Accordingly, this invention provides a retractable platform structure comprising: a central framework portion, four main floor panels extending outwardly from the framework portion in directions defining a cross, each main floor panel being pivotally mounted on said framework portion for movement between a first position in which it extends substantially horizontally away from the framework portion and a second position in which it extends substantially vertically upward in close juxtaposition with said framework portion, and a plurality of secondary floor panels disposed in the quadrants between the main floor panels, each secondary floor panel being pivotally mounted to another panel along juxtaposed aligned edges, and each secondary floor panel being capable of pivotal movement between a first position in which it extends in a horizontal plane and a second position in which it is folded through at least 90° thereby to permit pivotal movement of its respective main floor panel to the said second position of the latter.

Figure 2A:
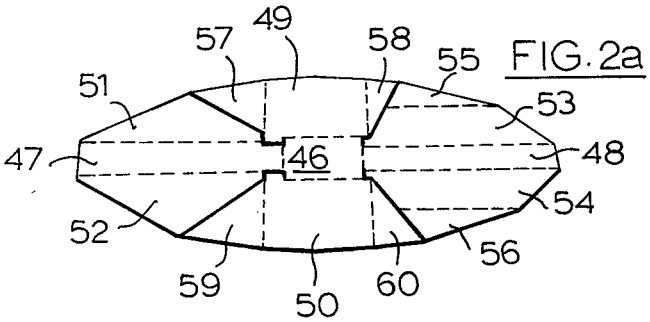
Figure 2C:
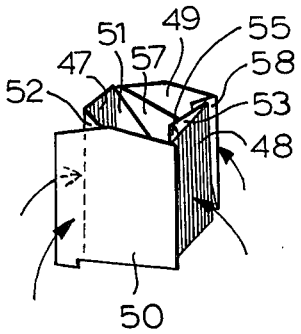
Figure 2B:
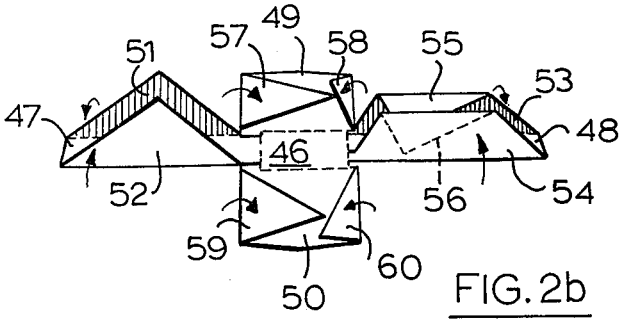
Figure 3:
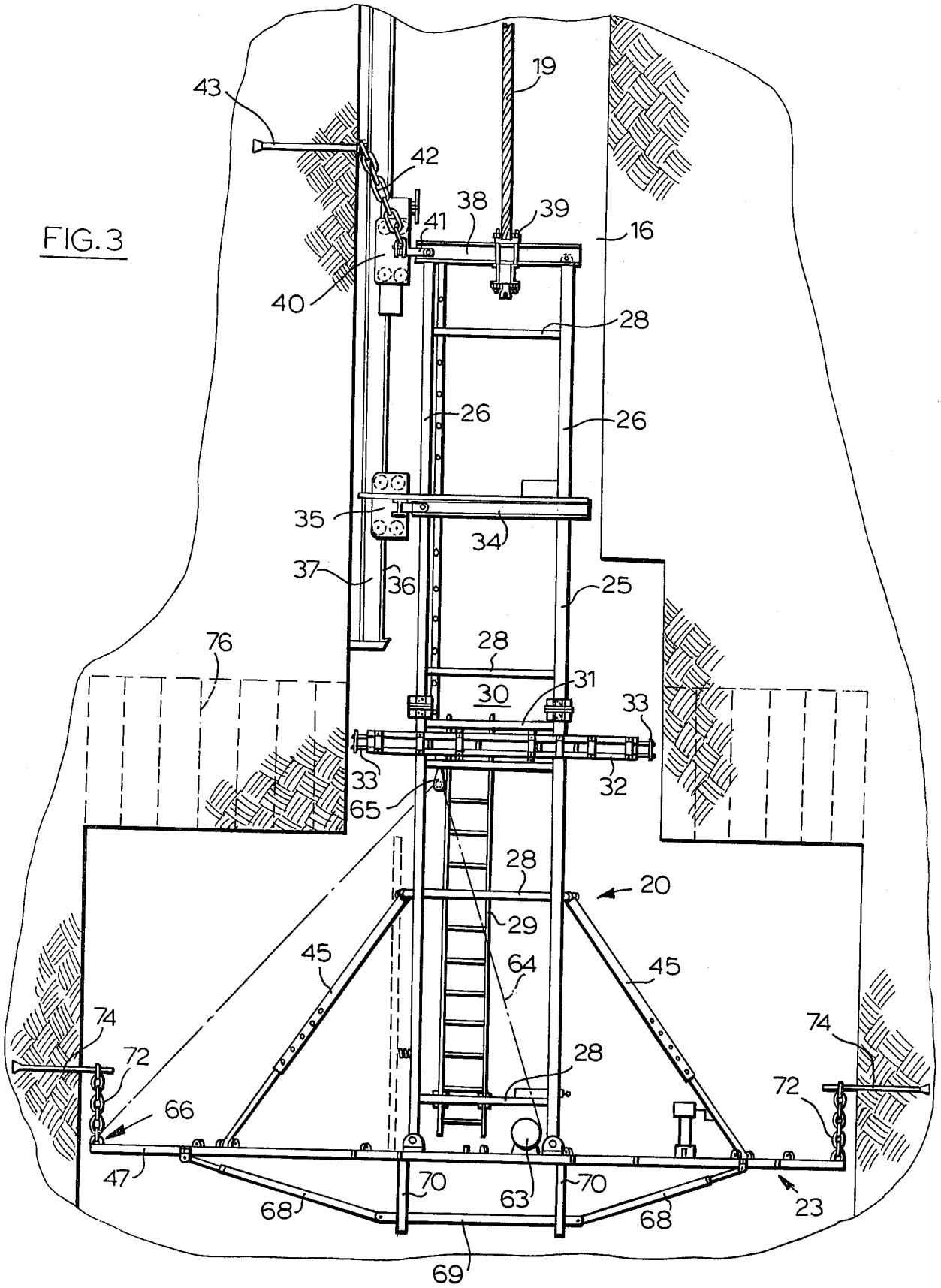
Figure 4:
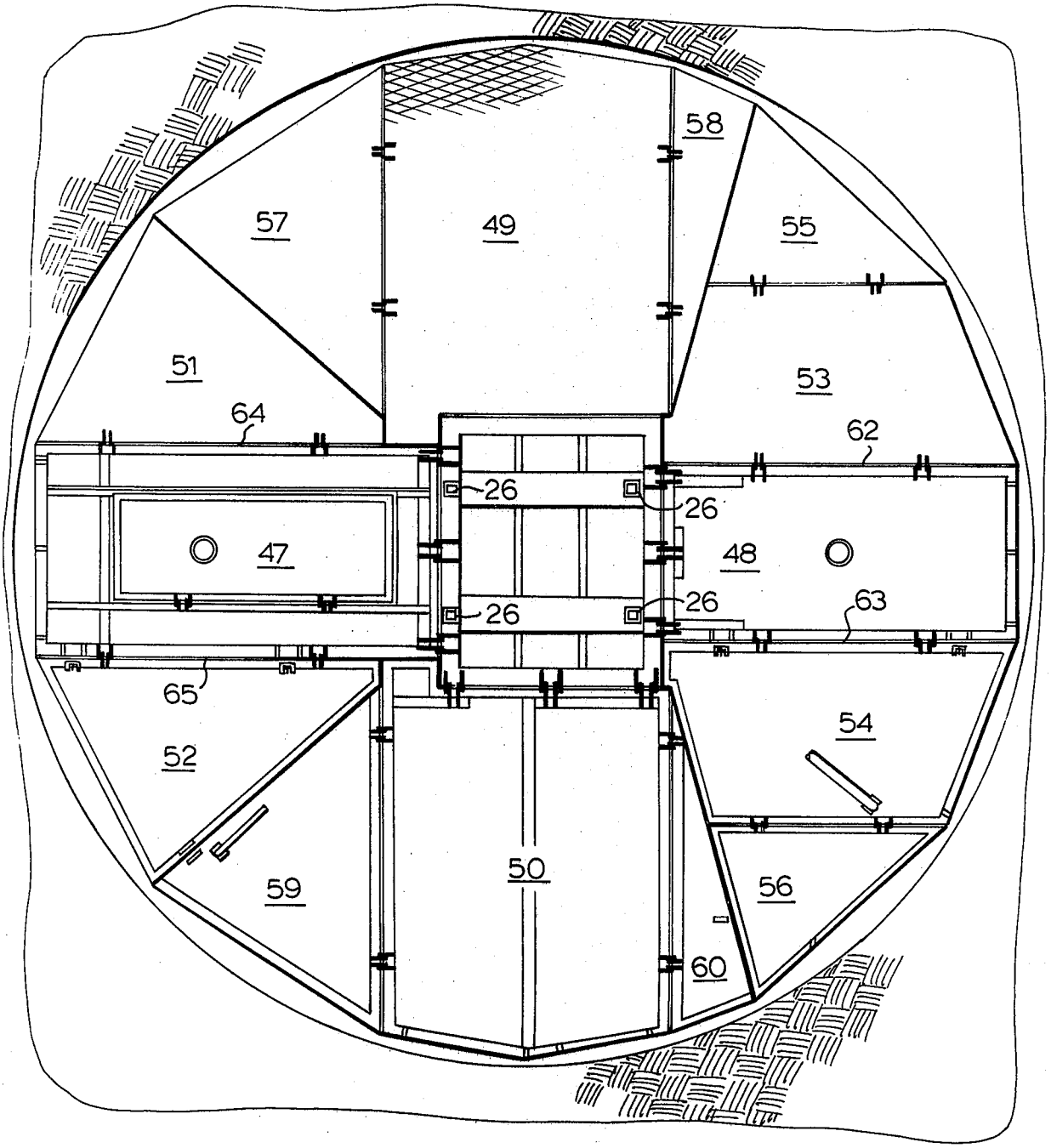
Figure 5:
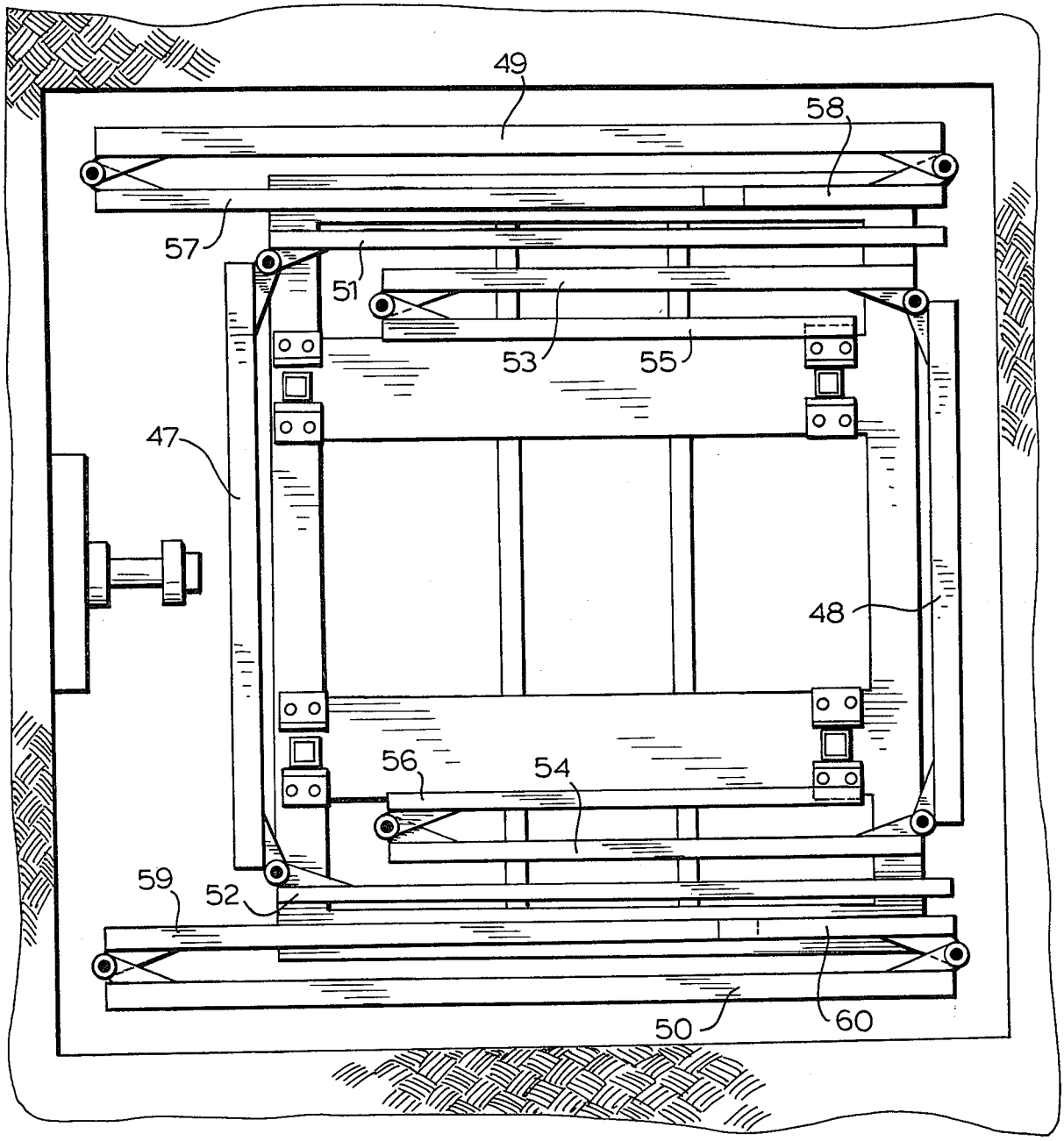

One embodiment of this invention is illustrated in the accompanying drawings, in which like numerals denote like parts throughout the several views, and in which:

FIG. 1 is a sectional view through the earth showing certain common portions of the shafts, etc. involved in a mining operation;

FIGS. 2A, 2B, and 2C are schematic drawings showing the basic procedure of folding utilized in this invention;

FIG. 3 is a vertical elevational view of the platform of this invention;

FIG. 4 is a sectional view taken along the horizontal line 4—4 in FIG. 3; and FIG. 5 is a view also taken along the line 4—4 in FIG. 3, but to a larger scale and showing the floor panels in their folded-up condition within the 8-foot portion of the shaft.

Attention is first directed to FIG. 1, which shows in vertical section a principal mine shaft 10 extending vertically downwardly from the surface 12 of the earth, and a single level 14 extending in opposite directions from the shaft 10. At a location spaced horizontally from the shaft 10, it may become desirable to provide an auxiliary shaft extending upwardly from the level 14 to the surface 12 of the earth. Shown schematically in FIG. 1 is a preliminary smaller-diameter shaft 16 which has already been cut from the surface 12 down to the level 14, the shaft 16 being roughly square and having a dimension of about 8 feet. Also shown schematically is a winch means 18 supporting a cable 19 to the lower end of which is attached a drilling platform 20 constructed in accordance with this invention. The utilization of the drilling platform 20 involves gradually raising the platform upwardly from the level 14 to the surface, and intermittently drilling blasting holes 22 vertically upwardly, blasting, and then clearing away the dislodged material.

More specifically, the drilling platform 20 includes a retractable floor 23 and a central framework 25. The floor 23 is adapted to fold outwardly into a horizontal position as shown in FIG. 1, so that workers can stand thereon to operate the drilling equipment necessary to cut the bore holes 22, and to pack these bore holes with blasting powder. Prior to blasting, the workers remove themselves from the floor 23 either by climbing up along the framework 25, or by moving some distance away from the blasting location along the level 14. Then the retractable floor 23 is folded upwardly and inwardly against the framework 25 (through mechanisms later to be described), the entire platform structure in its retracted condition is withdrawn upwardly some distance into the smaller-diameter portion (eight feet or so) of the shaft 16, and the blasting powder is set off. The dislodged material will fall down onto the floor of the level 14, from where it can be removed horizontally over to the main shaft 10, raised up in the main shaft 10 and disposed of on the surface.

The process is then repeated, with the platform structure 20 being lowered down to where the floor 23 can be folded out into the horizontal position again, and a new set of bore holes is drilled by workers again standing on the floor 23. This process is repeated continuously throughout the vertical length of the new shaft.

and an enlarged shaft having a diameter in the area of 25–30 feet results when the operation is completed.

Attention is now directed to FIGS. 3 and 4 which show the basic constructional configuration of the platform structure 20 of this invention. The central framework 25 is seen to be vertically elongated and includes four vertical upright members 26 and a plurality of intermediate cross struts 28 forming a rigid open structure with the members 26. As can be seen particularly in FIG. 4, the upright members 26 are arranged in approximately rectangular configuration.

A ladder 29 is affixed to the lower cross struts 28 and is aligned vertically to permit workers to climb from the retractable floor 23 to a higher level identified by the numberal 30, where a small supporting floor panel 31 is provided. Located just beneath the floor panel 31 is a device 32 generally known as a "stinger", which typically operates on a hydraulic principle and is able to extend horizontally outwardly in opposite directions two bit heads 33, having high-hardness contact portions at the distal ends which are adapted to bite into the cut-away wall of earth defining the shaft at that location. The stinger 32 is provided as an auxiliary safety retention means to ensure against accidental release and falling of the platform structure. Located above the stinger 32 is a cross frame member 34 which is securely attached to a carriage member 35 adapted to ride along the outer flange 36 of an I-beam 37 firmly affixed against the side wall and narrow portion of the shaft 16. The I-beam track 37 is provided in short sections, so that the lowermost sections can be dismantled and removed as the blasting work progresses upwardly.

A further cross beam 38 is provided at the upper end of the central framework 25, to the mid-portion of which is attached a clamping means 39 adapted to be secured to the lower end of the winch cable 19. The cross beam 38 also is attached to another carriage 40 which is likewise adapted to ride along the flange 36 of the I-beam track 37. Additionally, the cross beam 38 has a means 41 to which a chain 42 may be secured, the other end of which can be attached to the ends of various earth-bolts 43 driven into the side wall of the preliminary shaft 16 at vertically spaced intervals.

The floor portion 23 of the platform structure includes a plurality of variously shaped panels hingedly connected together and supported, when in the horizontal position, by a plurality of detachable angled struts 45 each attached at its upper end to one of the cross struts 28, and each attached at its lower end to one of the individual panels just mentioned.

The arrangement of the specific panels making up the floor structure of the preferred embodiment of this invention is best illustrated in FIGS. 2A and 4. FIG. 4 is a true plan view, while FIG. 2A is an oblique view looking downwardly from an angle. Thus, in FIG. 2A the specific shapes are somewhat distorted, but the arrangement and general configuration corresponds to that seen in FIG. 4. In FIG. 2A, which is a more schematic view than that of FIG. 4, the lines along which pairs of panels are hinged together are shown as broken lines, whereas the lines along which there is no attachment between the panels are shown as solid lines. In FIG. 2A, a central rectangular portion 46 is intended to represent the lower end of the framework portion 25 of the platform structure, to which all of the panels ultimately are connected (either directly or through connection to intermediate panels). Looking simultaneously at FIGS. 2A and 4, the floor panels can be divided into four main panels 47, 48, 49 and 50 and ten secondary panels which will be identified subsequently by number. The secondary panels fill the quadrants defined between adjacent pairs of the main panels 47–50.

Each of the main floor panels 47–50 is pivotally mounted directly to the central rectangle 46 representing the lower end of the framework structure, while each of the secondary panels is joined only indirectly to the rectangle 46—either by being pivoted to one of the main panels, or by being pivoted to another panel which itself is pivoted to one of the main panels.

Some of the pivot connections between hinged adjacent panels are such as to allow the panels to fold through 90° with respect to each other, and others of such connections allow pivotal movement through 180° so that the panels can be folded to lie flat against each other.

Dealing with the configurations of the panels more specifically, it will be seen that each main panel is defined in part by an inner rectiliner edge along which it is pivotally mounted to the framework portion (the inner rectangle 46 in FIG. 2A), and two parallel spaced-apart rectilinear side edges perpendicular to said inner edge. Moreover, each such side edge of a main panel has one of the secondary floor panels pivotally mounted to it, and therefore none of the side edges of the main panels is free.

Even more specifically, the first main panel 47 is pivotally connected to two substantially triangular secondary floor panels 51 and 52, one such triangular secondary floor panel being connected to each of the two side edges of the first main panel 47. The second main floor panel 48 is the one located 180° from the first main floor panel 47, and has two substantially trapezoidal secondary floor panels 53 and 54 pivotally mounted to its two parallel side edges. Furthermoe, each of these two trapezoidal secondary floor panels 53 and 54 has a triangular secondary floor panel 55 and 56, respectively, pivotally mounted to the edge of the trapezoidal panel which is remote from the edge of attachment between the trapezoidal panel and main floor panel 48. The main floor panel 49 has two substantially triangular secondary floor panels 57 and 58 pivotally mounted to its two side edges, while the main floor panel 50 has two substantially triangular secondary floor panels 59 and 60 pivotally mounted to its two side edges. It will thus be seen that two of the quadrants between main panels are filled by two triangular secondary panels each, and that the other two of the quadrants are each filled by one trapezoidal and two triangular panels.

The manner in which the various panels are folded together and then into an upright position in close juxtaposition with the framework 25 is illustrated in FIGS. 2B and 2C. FIG. 2B shows that panels 57, 58, 59 and 60 are folded first through 180° to lie flat against their respective main panels 49 and 50, this taking place while the main panels 49 and 50 remain horizontally positioned. The triangular panels 55 and 56 are also folded through 180° to lie flat against their respective trapezoidal panels 53 and 54, and then the latter two panels are folded up to a 90° position with respect to their main panel 48. The triangular panels 51 and 52 are folded through 90° to an upright position with respect to the main panel 47. All of the main panels 47, 48, 49 and 50 thus far have remained in the horizontal position.

As best seen in FIG. 4, the hinge lines 62 and 63 along which the trapezoidal panels 53 and 54 are hinged to their main panel 48 are spaced closer together than the hinge lines 64 and 65 between the first main panel 47 and its respective triangular panels 51 and 52. Both of the hinge lines 62 and 63, if extended, would pass to the inside of the hinge lines 64 and 65, and this means that when the main panels 47 and 48 (together with their secondary panels) are each folded through 90° into the upright position to lie in close juxtaposition with the framework portion 25, the folded panels 54 and 56 are interleaved with the triangular panel 52, while the folded panels 53 and 55 are interleaved with the triangular panel 51. In effect, the triangular panels 51 and 52 lie to the outside of the other secondary panels just mentioned.

Reference may be made briefly to FIG. 5, which is a horizontal section through the various floor panels when in their upright folded-together position. From the identification of the various panels by their respective numerals, the nature of the interleaved relationship between panels 51, 52, 53, 54, 55 and 56 can be clearly seen.

To complete the folding together of the various floor panels into the configuration shown in FIG. 2C, the main floor panels 49 and 50 are folded through 90° into the upright position to lie in juxtaposition just to the outside of the respective triangular panels 51 and 52. This also is clearly shown in FIG. 5.

It will be realized from the above that there is considerable latitude in the order in which the various panels are folded together and then to the upright position. The only limitation is the requirement that each main panel and its adjoined secondary panels be placed first in the condition shown for the particular panels in FIG. 2B, before these panels are folded up to assume the configuration of FIG. 2C. However, the order in which the main panels are folded from the condition of FIG. 2B to the condition of FIG. 2C is not restricted.

One preferred method by which the panels may be folded up into the respective folded conditions is illustrated in FIG. 2 schematically as involving a winch-/motor combination 63, a winching cable 64 passing over a pulley 65, and a connection at 66 at the distal end of the main panel 47.

In addition to the support struts 45 shown in FIG. 3, there may also be provided undergirding struts 68 in a triangular relationship between an intermediate point on one of the main panels and a lower cross brace 69 supported below the main level of the floor on two downwardly projecting support members 70.

An additional means may be provided to hold the platform structure in place, and this is illustrated in FIG. 3 as a plurality of chains 72 attached to the distal ends of various of the floor panels, and connecting these ends to wall bolts 74 driven into the vertical surface of the shaft being cut. The broken lines 76 in FIG. 3 represent bore holes drilled upwardly by workers standing on the platform, and prior to the blasting away of the earth encompassed by the group of bore holes.

I claim:

1. A rectractable platform structure comprising: a central framework portion, four main floor panels extending outwardly from the framework portion in directions defining a cross, and including a first main floor panel, a second main floor panel disposed at 180° from the first, and third and fourth main floor panels each disposed at 90° from the first, each main floor panel being pivotally mounted on said framework portion for movement between a first position in which it extends substantially horizontally away from the framework portion and a second position in which it extends substantially vertically upward in close juxtaposition with said framework portion, and a plurality of secondary floor panels disposed in the quadrants between the main floor panels, each secondary floor panel being pivotally mounted to another panel along juxtaposed aligned edges, and each secondary floor panel being capable of pivotal movement between a first position in which it extends in a horizontal plane and a second position in which it is folded through at least 90°, all panels being substantially coplanar when they are horizontally disposed, each main panel being defined in part by an inner rectilinear edge along which it is pivotally mounted to said framework portion, and two parallel spaced-apart rectilinear side edges perpendicular to said inner edge, said first main floor panel having a substantially triangular secondary floor panel pivotally mounted to each of its two side edges, said second main floor panel having a substantially trapezoidal secondary floor panel pivotally mounted to each of its two side edges, each trapezoidal secondary floor panel having a triangular secondary floor panel pivotally mounted to the edge remote from its edge of attachment to the main floor panel, each of said third and fourth main floor panels having a substantially triangular secondary floor panel pivotally mounted to each of its two side edges, whereby two of the quadrants between main panels are filled by two triangular secondary panels each, and the other two of such quadrants are filled by two triangular and one trapezoidal secondary panel each.

2. The invention claimed in claim 1, in which all panels are so configured as (a) to enable the secondary panels belonging to said first main panel to each fold through 90° with respect thereto and to be received adjacent opposite sides of said framework portion as said first panel folds up to its vertical position in juxtaposition with the framework portion, (b) to enable the triangular secondary panels mounted to said trapezoidal panels to fold through 180° and lie against their respective trapezoidal panels; (c) to enable the trapezoidal panels when their respective triangular panels are folded as in (b) hereof to fold through 90° with respect to said second main panel and to be received adjacent opposite sides of said framework portion and parallel with the triangular secondary panels referred to in (a) hereof; and (d) to enable the two triangular secondary panels mounted to each of the third and fourth main panels to be folded through 180° and lie against their respective main panel without overlapping each other, the pivoting axis between each of said third and fourth main panels and the framework portion being located so as to allow each said third and fourth main panel with its secondary panels folded overtop of it to swing through 90° to a vertical position in which it is located outside of all secondary panels mounted to said first and second main panels.

3. The invention claimed in claim 1, in which the framework portion is a vertically elongated structure substantially rectangular in horizontal section, and in which there is further provided strut means for supporting all floor panels in the horizontal position, the invention further including means at the top of the framework portion to which a cable means may be attached, and at least one additional independent means for holding the platform structure in a given vertical positon in a mine shaft.

* * * * *